US011111751B1

(12) United States Patent
Couren et al.

(10) Patent No.: US 11,111,751 B1
(45) Date of Patent: Sep. 7, 2021

(54) BLOWOUT PREVENTER WITH DUAL FUNCTION RAMS

(71) Applicant: Cameron International Corporation, Houston, TX (US)

(72) Inventors: Patrice Couren, Beziers (FR); Florent Vargas, Beziers (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 16/812,421

(22) Filed: Mar. 9, 2020

(51) Int. Cl.
*E21B 33/06* (2006.01)
*E21B 33/08* (2006.01)

(52) U.S. Cl.
CPC ..... *E21B 33/063* (2013.01); *E21B 33/06* (2013.01); *E21B 33/061* (2013.01); *E21B 33/062* (2013.01); *E21B 33/085* (2013.01)

(58) Field of Classification Search
CPC ..... E21B 33/06; E21B 33/061; E21B 33/062; E21B 33/063; E21B 33/085
USPC ..... 251/1.1, 1.2
See application file for complete search history.

(56) References Cited

U.S. PATENT DOCUMENTS 1,834,063 A * 12/1931 King ..... E21B 33/062 137/460
1,886,340 A * 11/1932 King ..... E21B 33/06 251/1.3
1,966,809 A * 7/1934 Wickersham ..... E21B 33/062 251/1.3
3,554,480 A * 1/1971 Rowe ..... E21B 33/062 251/1.3
4,526,339 A * 7/1985 Miller ..... E21B 33/062 251/1.3
6,161,618 A 12/2000 Parks et al.
6,209,565 B1 4/2001 Hughes et al.
6,644,410 B1 11/2003 Lindsey-Curran et al.
7,216,714 B2 5/2007 Reynolds
7,216,715 B2 5/2007 Reynolds
7,222,674 B2 5/2007 Reynolds
7,690,433 B2 4/2010 Reynolds
8,020,623 B2 9/2011 Parks et al.
8,607,879 B2 12/2013 Reynolds
8,727,013 B2 5/2014 Buckley et al.
8,820,410 B2 9/2014 Parks et al.
9,505,473 B2 11/2016 Kerins et al.
2014/0048275 A1 2/2014 Reynolds et al.
2017/0130549 A1* 5/2017 Kroesen ..... E21B 33/061

FOREIGN PATENT DOCUMENTS

GB 2357537 A 6/2001
WO 2009025732 A1 2/2009

* cited by examiner

*Primary Examiner* — Umashankar Venkatesan

(57) ABSTRACT

A dual function ram system for a blowout preventer (BOP) includes a first dual function ram that is configured to move within a cavity of the BOP between a withdrawn position to cause the BOP to be in an open configuration and an extended position to cause the BOP to be in a closed configuration. The first dual function ram includes a shearing surface that is configured to shear a tubular within a central bore during a shearing operation and a pipe-sealing surface that is configured to seal against the tubular within the central bore during a pipe-sealing operation.

18 Claims, 13 Drawing Sheets

BLOWOUT PREVENTER WITH DUAL FUNCTION RAMS

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

A blowout preventer (BOP) is installed on a wellhead to seal and control an oil and gas well during various operations. For example, during drilling operations, a drill string may be suspended from a rig through the BOP into a wellbore. A drilling fluid is delivered through the drill string and returned up through an annulus between the drill string and a casing that lines the wellbore. In the event of a rapid invasion of formation fluid in the annulus, commonly known as a "kick," the BOP may be actuated to seal the annulus and to control fluid pressure in the wellbore, thereby protecting well equipment positioned above the BOP.

BRIEF DESCRIPTION OF THE DRAWINGS

Various features, aspects, and advantages of the present disclosure will become better understood when the following detailed description is read with reference to the accompanying figures in which like characters represent like parts throughout the figures, wherein.

DETAILED DESCRIPTION OF SPECIFIC EMBODIMENTS

Figure 1:
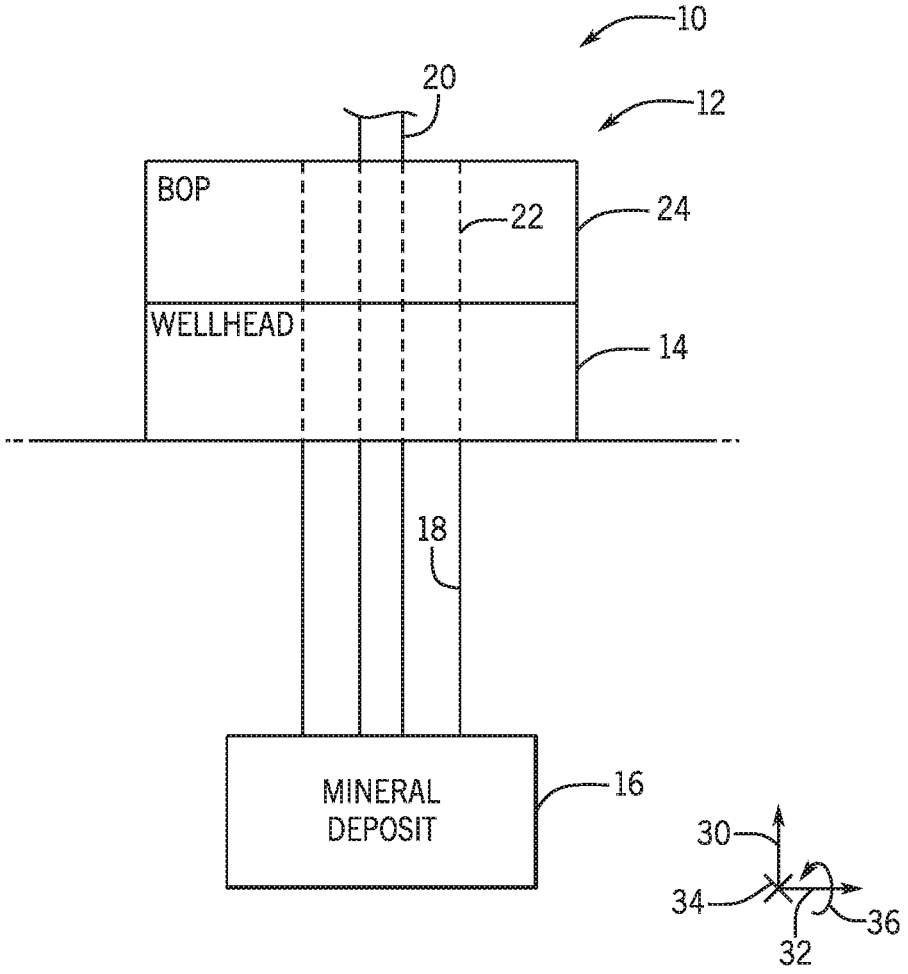
FIG. 1 is a block diagram of a mineral extraction system, in accordance with an embodiment of the present disclosure.

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The present embodiments are generally directed to blowout preventers (BOPs). In particular, the present embodiments are generally directed to BOPs that include dual function rams supported within a cavity that is transverse to a central bore of the BOP. The dual function rams may move within the cavity toward one another to an extended position to adjust the BOP to a closed configuration to block fluid flow through the central bore of the BOP and away from one another to a withdrawn position to adjust the BOP to an open configuration to enable fluid flow through the central bore of the BOP. As discussed in more detail below, the dual function rams are configured to operate in two modes. For example, the dual function rams may operate in a pipe mode to seal an annular space about a conduit within the central bore of the BOP during a first operation, and the dual function rams may then be rotated within the cavity (e.g., relative to the cavity) to operate in a shear mode to shear the conduit within the central bore of the BOP during a second operation. The disclosed features may reduce a height of a BOP stack (e.g., having the BOP) and/or enable the BOP stack to include additional BOPs without increasing the height of the BOP stack, for example.

While the disclosed embodiments are described in the context of a drilling system and drilling operations to facilitate discussion, it should be appreciated that the BOP may be adapted for use in other contexts and during other operations. For example, the BOP may be used in a production system and/or a pressure control equipment (PCE) stack that is coupled to and/or positioned vertically above a wellhead during various intervention operations (e.g., inspection or service operations), such as wireline operations in which a tool supported on a wireline is lowered through the PCE stack to enable inspection and/or maintenance of a well. In such cases, the BOP may be adjusted from the open configuration to the closed configuration (e.g., to shear or to seal about the wireline extending through the PCE stack) to isolate the environment, as well as other surface equipment, from pressurized fluid within the well. In the present disclosure, a conduit may be any of a variety of tubular or cylindrical structures, such as a drill string, wireline, Streamline™, slickline, coiled tubing, or other spoolable rod.

With the foregoing in mind, FIG. 1 is a block diagram of an embodiment of a mineral extraction system 10. The mineral extraction system 10 may be configured to extract various minerals and natural resources, including hydrocarbons (e.g., oil and/or natural gas), from the earth and/or to inject substances into the earth. The mineral extraction system 10 may be a land-based system (e.g., a surface system) or an offshore system (e.g., an offshore platform system).

As shown, a BOP stack 12 may be mounted to a wellhead 14, which is coupled to a mineral deposit 16 via a wellbore 18. The wellhead 14 may include any of a variety of other components such as a spool, a hanger, and a "Christmas" tree. The wellhead 14 may return drilling fluid or mud toward a surface during drilling operations, for example. Downhole operations are carried out by a conduit 20 (e.g., drill string) that extends through a central bore 22 of the BOP stack 12, through the wellhead 14, and into the wellbore 18.

As discussed in more detail below, the BOP stack 12 may include one or more BOPs 24 (e.g., ram BOPs), and at least one of the BOPs 24 may include dual function rams. To facilitate discussion, the BOP stack 12 and its components may be described with reference to a vertical axis or direction 30, an axial axis or direction 32, a lateral axis or direction 34, and a circumferential axis or direction 36.

Figure 2:
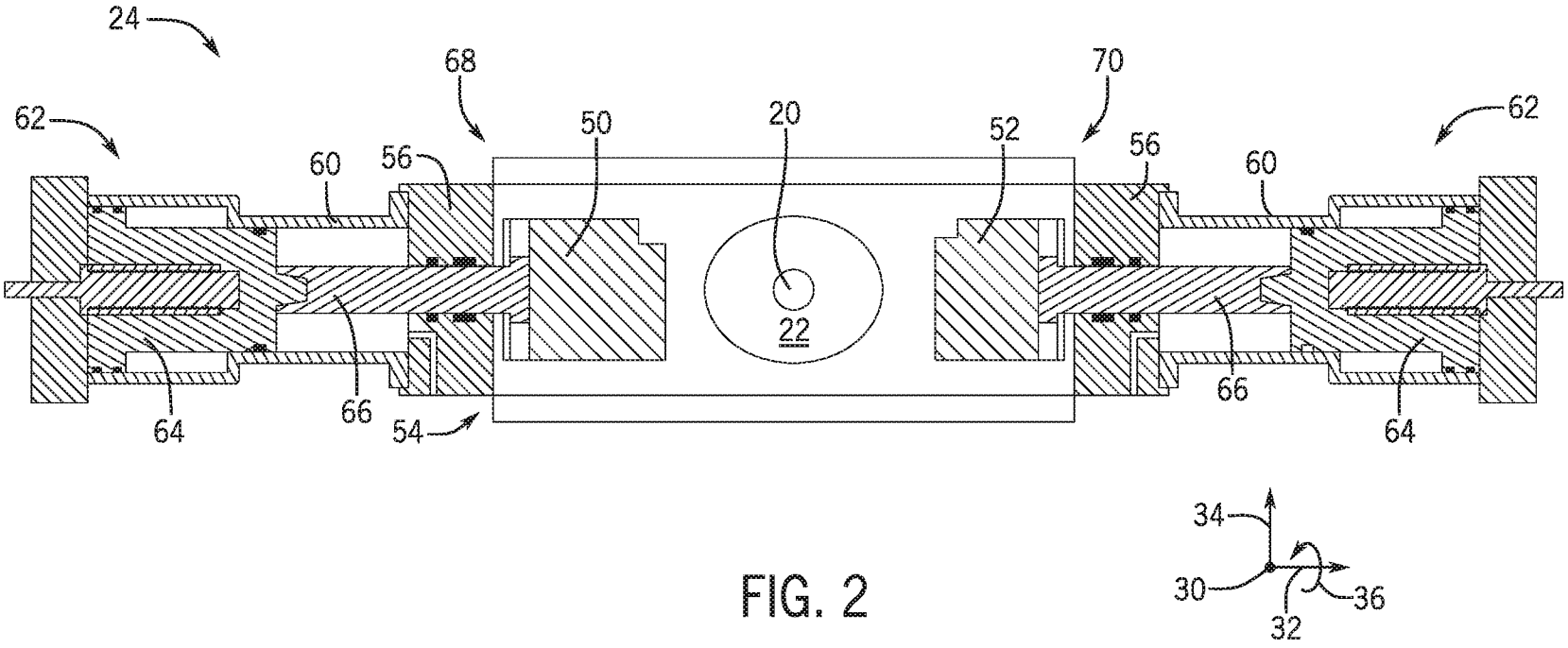
FIG. 2 is a cross-sectional top view of a portion of a blowout preventer (BOP) that may be used in the mineral extraction system of FIG. 1, in accordance with an embodiment of the present disclosure.

FIG. 2 is a cross-sectional top view of a portion of the BOP 24 that may be used in the mineral extraction system 10 of FIG. 1, in accordance with an embodiment of the present disclosure. As shown, a first dual function ram 50 (e.g., first ram) and a second dual function ram 52 (e.g., second ram) are positioned such that the BOP 24 is in an open configuration 54. In the open configuration 54, the first dual function ram 50 and the second dual function ram 52 are withdrawn from the central bore 22, do not contact the conduit 20, and/or do not contact the corresponding opposing ram 50, 52.

As shown, the BOP 24 includes a body 56 (e.g., housing) surrounding the central bore 22. The body 56 is generally rectangular in the illustrated embodiment, although the body 56 may have any cross-sectional shape, including any polygonal shape and/or annular shape. Bonnet assemblies 60 are mounted to the body 56 (e.g., via threaded fasteners). In the illustrated embodiment, first and second bonnet assemblies 60 are mounted to opposite sides of the body 56. Each bonnet assembly 60 supports an actuator 62, which may include a piston 64 and a connecting rod 66. As shown in the illustrated embodiment of FIG. 2, when in the open configuration 54, the first dual function ram 50 is generally adjacent to a first end 68 of the body 56 and the second dual function ram 52 is generally adjacent to a second end 70, opposite the first end 68, of the body 56. The actuators 62 may drive the first and second dual function rams 50, 52 toward and away from one another along the axial axis 32 and through the central bore 22 to contact and/or shear the conduit 20 to seal the central bore 22. As discussed in more detail below, the first and second dual function rams 50, 52 may be configured to operate in two modes via rotation of the first and second dual function rams 50, 52 relative to the body 56.

Figure 3:
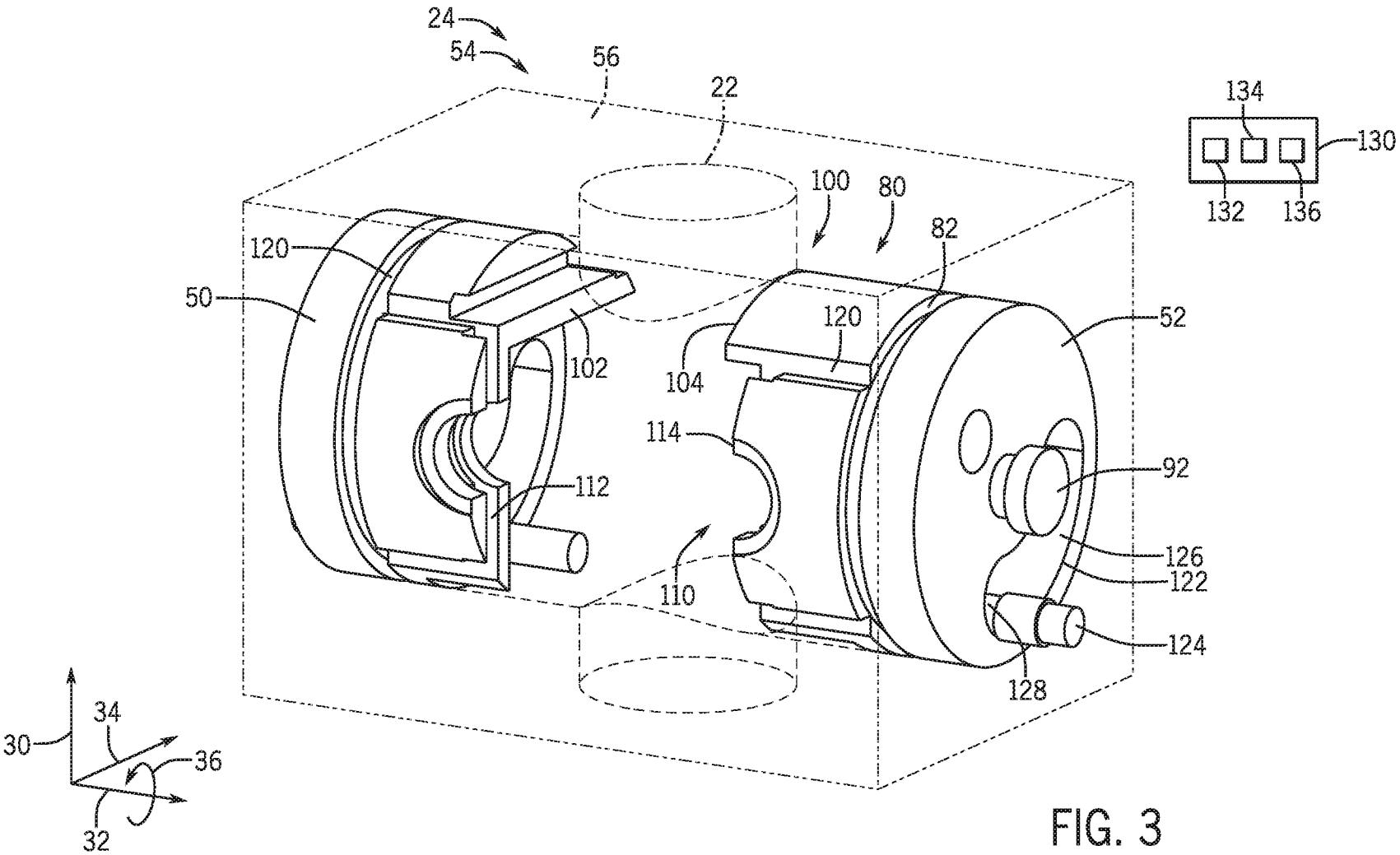
FIG. 3 is a perspective view of dual function rams that may be used in the BOP of FIG. 2, wherein the dual function rams are in a first mode and are in a withdrawn position, in accordance with an embodiment of the present disclosure.

FIG. 3 is a perspective view of the first dual function ram 50 and the second dual function ram 52 in a first mode 80 (e.g., shear mode; first position; first position along the circumferential axis 36) and withdrawn from the central bore 22 such that the BOP 24 is in the open configuration 54. As shown, the first dual function ram 50 and the second dual function ram 52 are supported within a cavity 82 (e.g., ram cavity) that is transverse to the central bore 22 of the BOP 24 (e.g., a respective central axis of the cavity 82 is transverse, such as orthogonal, to a respective central axis of the central bore 22; a respective central axis of the cavity 82 is aligned with the axial axis 32 and a respective central axis of the central bore 22 is aligned with the vertical axis 30). In operation, the first dual function ram 50 and the second dual function ram 52 move through the cavity 82 toward and away from one another.

Figure 4:
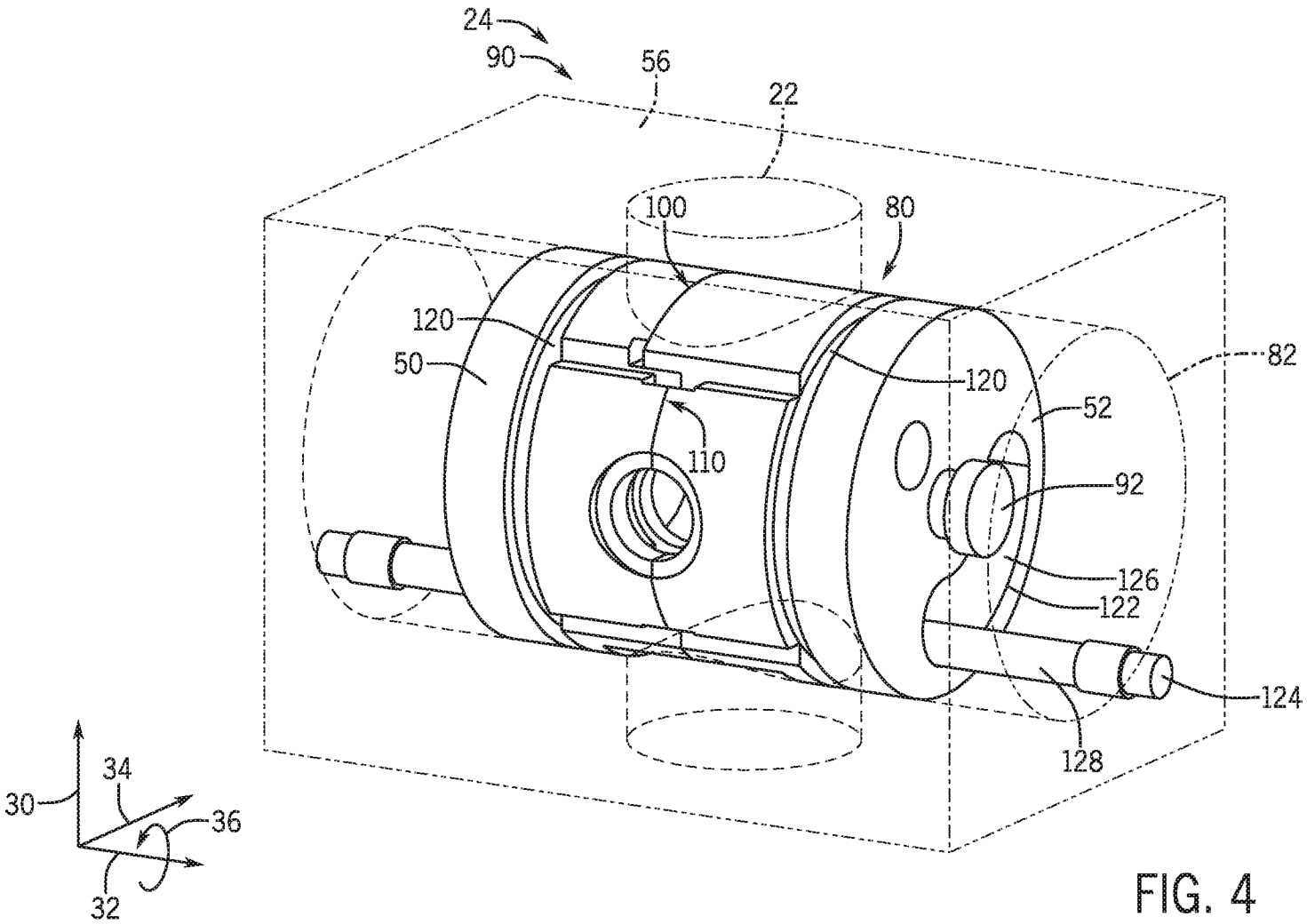
FIG. 4 is a perspective view of the dual function rams of FIG. 3, wherein the dual function rams are in the first mode and are in an extended position, in accordance with an embodiment of the present disclosure.

For example, the first dual function ram 50 and the second dual function ram 52 may move toward one another to transition the BOP 24 from the open configuration 54 of FIG. 3 to a closed configuration 90 of FIG. 4. Similarly, the first dual function ram 50 and the second dual function ram 52 may move away from one another to transition the BOP 24 from the closed configuration 90 of FIG. 4 to the open configuration 54 of FIG. 3. In the closed configuration 90, the first dual function ram 50 and the second dual function ram 52 extend into the central bore 22, seal the central bore 22, contact the conduit 20, and/or contact the corresponding opposing ram 50, 52. The first dual function ram 50 and the second dual function ram 52 may be driven to move toward and away from one another along the axial axis 32 via the actuator 62 of FIG. 2. For example, the first dual function ram 50 and the second dual function ram 52 may each include a respective feature 92 (e.g., protrusion) that is configured to couple (e.g., rotatably or nonrotatably couple) to a respective connecting rod 66 of a respective actuator 62 to enable the actuators 62 to drive the first dual function ram 50 and the second dual function ram 52 toward and away from one another along the axial axis 32.

As noted above, the first dual function ram 50 and the second dual function ram 52 may be configured to operate in two modes (e.g., different modes, which may correspond to different positions of the first and second dual function rams 50, 52 within the cavity 82), such as the first mode 80 and a second mode. To enable the first and second dual function rams 50, 52 to operate in two modes, the first and second dual function rams 50, 52 may have two sets of opposing surfaces that are configured to engage one another. The two sets of opposing surfaces may be offset (e.g., about the circumferential axis 36) from one another such that only one of the two sets of opposing surface is positioned within the central bore 22 while the first and second dual function rams 50, 52 are extended with the BOP 24 in the closed configuration 90 of FIG. 4. The other set of the two sets of opposing surfaces is positioned outside of the central bore 22 while the first and second dual function rams 50, 52 are extended with the BOP 24 in the closed configuration 90 of FIG. 4.

With reference to FIGS. 3 and 4, the first and second dual function rams 50, 52 include a first set of opposing surfaces 100 that includes a first shear edge 102 (e.g., surface) on the first dual function ram 50 (e.g., on a body of the first dual function ram 50; on a portion of the body) and a second shear edge 104 (e.g., surface) on the second dual function ram 52 (e.g., on a body of the second dual function ram 52;

on a portion of the body). In the first mode 80 (e.g., shear mode), the first shear edge 102 and the second shear edge 104 are positioned such that the first shear edge 102 and the second shear edge 104 will enter the central bore 22 as the first and second dual function rams 50, 52 are driven to adjust the BOP 24 to the closed configuration 90 of FIG. 4. In particular, in the first mode 80, the first shear edge 102 and the second shear edge 104 may extend along the lateral axis 34, may be positioned at an upper portion of the cavity 82 along the vertical axis 30, and/or may face toward one another so as to enable the first shear edge 102 and the second shear edge 104 to contact and to shear the conduit 20 (FIG. 2) within the central bore 22.

As shown in FIGS. 3 and 4, the first and second dual function rams 50, 52 also include a second set of opposing surfaces 110 that includes a first pipe edge 112 (e.g., surface) on the first dual function ram 50 (e.g., on the body of the first dual function ram 50; on a portion of the body) and a second pipe edge 112 (e.g., surface) on the second dual function ram 52 (e.g., on the body of the second dual function ram 52; on a portion of the body). In the first mode 80 (e.g., shear mode), the first pipe edge 112 and the second pipe edge 114 are positioned such that the first pipe edge 112 and the second pipe edge 114 do not enter the central bore 22 as the first and second dual function rams 50, 52 are driven to adjust the BOP 24 to the closed configuration 90 of FIG. 4. In particular, in the first mode 80, the first pipe edge 112 and the second pipe edge 114 may extend along the vertical axis 30 and/or may be positioned at a first side portion of the cavity 82 along the lateral axis 34 so as to enable the first pipe edge 112 and the second pipe edge 114 to avoid contact with the conduit 20 (FIG. 2) in the central bore 22, to avoid placement within the central bore 22, and/or to avoid interference with the operation (e.g., shearing operation) of the first shear edge 102 and the second shear edge 104. In this way, the first pipe edge 112 and the second pipe edge 114 may move with the first shear edge 102 and the second shear edge 104 along the axial axis 32, but may be blocked from entry into the central bore 22 while the first shear edge 102 and the second shear edge 104 are positioned within the central bore 22. In the first mode 80, the first pipe edge 112 and the second pipe edge 114 may contact one another and may provide support (e.g., structural support) to the first and second dual function rams 50, 52.

Figure 5:
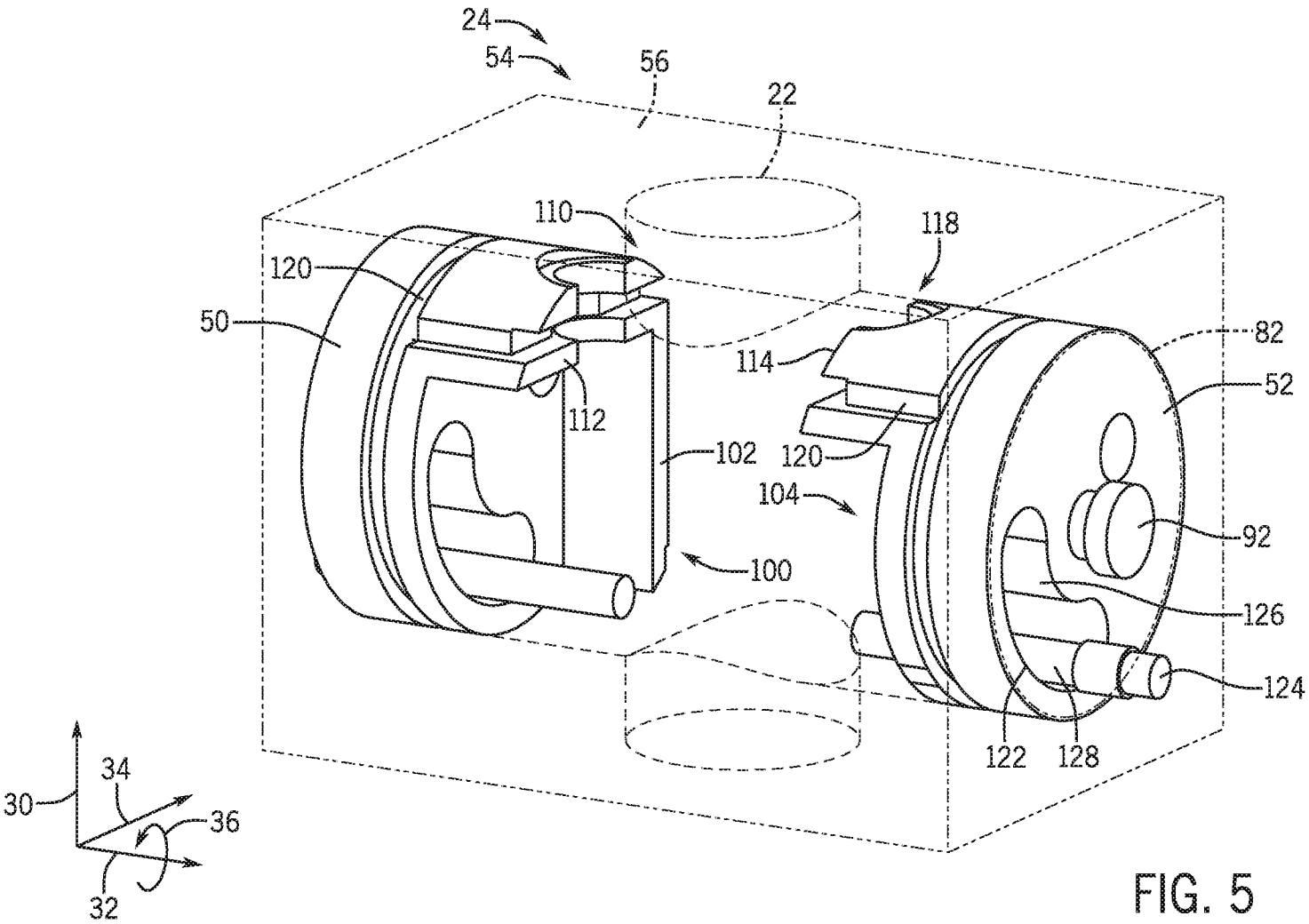
FIG. 5 is a perspective view of the dual function rams of FIG. 3, wherein the dual function rams are in a second mode and are in the withdrawn position, in accordance with an embodiment of the present disclosure.
Figure 6:
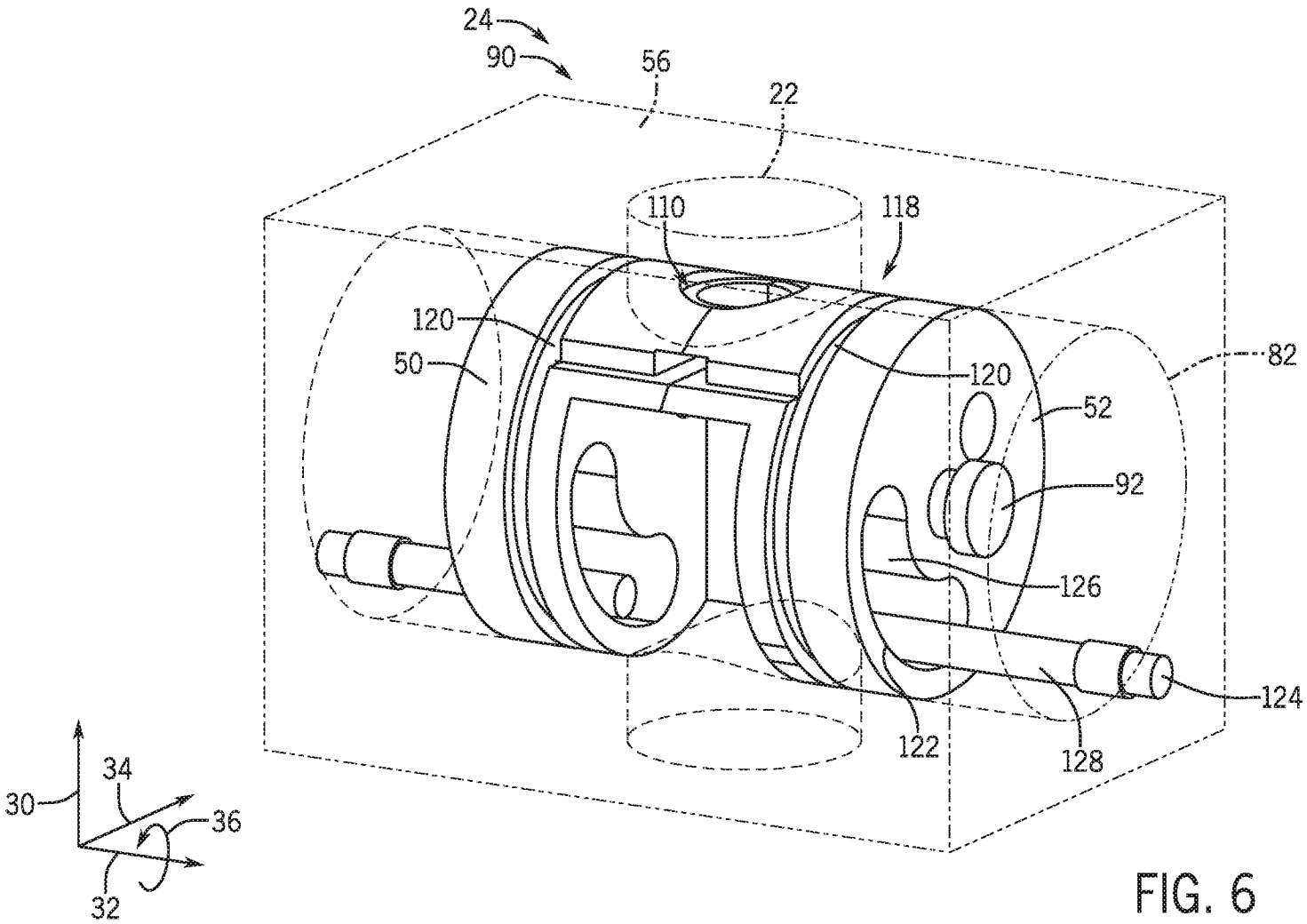
FIG. 6 is a perspective view of the dual function rams of FIG. 3, wherein the dual function rams are in the second mode and are in the extended position, in accordance with an embodiment of the present disclosure.

FIG. 5 is a perspective view of the first dual function ram 50 and the second dual function ram 52 in a second mode 118 (e.g., pipe-sealing mode mode; second position; second position along the circumferential axis 36) and withdrawn from the central bore 22 such that the BOP 24 is in the open configuration 54. FIG. 6 is a perspective view of the first dual function ram 50 and the second dual function ram 52 in the second mode 118 and extended into the central bore 22 such that the BOP 24 is in the closed configuration 90. The first dual function ram 50 and the second dual function ram 52 may move toward and away from one another to transition the BOP 24 between the open configuration 54 of FIG. 5 and the closed configuration 90 of FIG. 6.

In the second mode 118, the first pipe edge 112 and the second pipe edge 114 are positioned such that the first pipe edge 112 and the second pipe edge 114 enter the central bore 22 as the first and second dual function rams 50, 52 are driven to adjust the BOP 24 to the closed configuration 90 of FIG. 6. In particular, in the second mode 118, the first pipe edge 112 and the second pipe edge 114 may extend along the lateral axis 34, may be positioned at an upper portion of the cavity 82 along the vertical axis 30, and/or may face toward one another so as to enable the first pipe edge 112 and the second pipe edge 114 to contact one another and to contact the conduit 20 (FIG. 2) in the central bore 22 to seal the annular space about the conduit 20.

In the second mode 118, the first shear edge 102 and the second shear edge 104 are positioned such that the first shear edge 102 and the second shear edge 104 do not enter the central bore 22 as the first and second dual function rams 50, 52 are driven to adjust the BOP 24 to the closed configuration 90 of FIG. 6. In particular, in the second mode 118, the first shear edge 102 and the second shear edge 104 may extend along the vertical axis 30 and/or may be positioned at a second side portion (e.g., opposite the first side portion) of the cavity 82 along the lateral axis 34 so as to enable the first shear edge 102 and the second shear edge 104 to avoid contact with the conduit 20 (FIG. 2) in the central bore 22, to avoid placement within the central bore 22, and/or to avoid interference with the operation (e.g., pipe-sealing operation) of the first pipe edge 112 and the second pipe edge 114. In this way, the first shear edge 102 and the second shear edge 104 may move with the first pipe edge 112 and the second pipe edge 114 along the axial axis 32, but may be blocked from entry into the central bore 22 while the first pipe edge 112 and the second pipe edge 114 are positioned within the central bore 22. In the second mode 118, the first shear edge 102 and the second shear edge 104 may contact one another and may provide support to the first and second dual function rams 50, 52.

As shown, the first dual function ram 50 and the second dual function ram 52 may be generally cylindrical structures and may include various sealing elements (e.g., packers) within grooves 120 to facilitate formation of a seal across the central bore 22 while the BOP 24 is in the closed configuration 90 (e.g., in both the first and second modes 80, 118). The grooves 120 are shown without the sealing elements for image clarity. For example, one sealing element may be positioned between the first shear edge 102 and the first pipe edge 112 along the circumferential axis 36. Additionally, the cylindrical shape may enable the first dual function ram 50 and the second dual function ram 52 to rotate within the cavity 82 (e.g., relative to the body 56; in the circumferential direction 36) to thereby efficiently transition between the first mode 80 and the second mode 118. In some embodiments, the first dual function ram 50 and the second dual function ram 52 may each include a respective groove 122 (e.g., curved groove, extending along the circumferential axis 36) that is configured to engage a respective rotating shaft 124. In particular, each groove 122 may include a toothed profile 126 (e.g., gear profile) and each rotating shaft 124 may include a corresponding toothed profile 128 (e.g., gear profile). Thus, as each rotating shaft 124 rotates (e.g., via an actuator, such as a motor), the engagement between the toothed profiles 126, 128 drives the respective dual function ram 50, 52 to rotate within the cavity 82. Alternatively, it should be appreciated that any other suitable mechanism, such as the actuator 62 (FIG. 2), may be capable of driving the first dual function ram 50 and the second dual function ram 52 to rotate within the cavity 82 (e.g., in addition to driving the movement along the axial axis 32).

Advantageously, the embodiment of the BOP 24 of FIGS. 3-6 may enable the BOP 24 to use the same rams (e.g., the first and second dual function rams 50, 52) to operate in two modes (e.g., the first mode 80 and the second mode 118) depending on which of the two modes is desired at the particular time. In this way, the embodiment of the BOP 24 of FIGS. 3-6 may enable the BOP 24 to use the same rams (e.g., the first and second dual function rams 50, 52) to carry out two operations (e.g., the shearing operation and the pipe-sealing operation) depending on which of the two operations is desired at the particular time. For example, the BOP 24 may operate in the second mode 118 to seal the annular space about the conduit 20 (FIG. 2) during planned maintenance operations, and the BOP 24 may be operate in the first mode 80 to shear the conduit 20 during an unexpected increase in pressure within the wellbore 18 (FIG. 1). The BOP 24 may efficiently switch between the first mode 80 and the second mode 118 via rotation of the first and second dual function rams 50, 52 within the cavity 82 (e.g., via the rotating shaft 124).

It should be appreciated that manual and/or electronic control may be utilized to rotate the first and second dual function rams 50, 52. For example, an operator may manually drive rotation of the rotating shaft 124 to rotate the first and second dual function rams 50, 52. Additionally or alternatively, a control system (e.g., electronic control system) may electronically control the rotation of the rotating shaft 124 (e.g., via control of an actuator) to rotate the first and second dual function rams 50, 52. For example, the control system may receive an input (e.g., input by an operator via a user interface; from a sensor that monitors a pressure within the wellbore 18 [FIG. 1]). In response to the input, the control system may control the rotation of the rotating shaft 124 to rotate the first and second dual function rams 50, 52 to the desired position that corresponds to the desired mode (e.g., the first or the second mode 80, 118) to prepare for and to enable operation in the desired mode. In some embodiments, the control system may also control the movement of the first and second dual function rams 50, 52 along the axial axis 32 to adjust the BOP 24 between the open configuration 54 and the closed configuration 90.

With reference to FIG. 3, the control system may include a controller 130 having a processor 132 and a memory device 134. The controller 130 may be part of or include a distributed controller or control system with one or more electronic controllers in communication with one another to carry out the various techniques disclosed herein. The processor 132 may also include one or more processors configured to execute software, such as software for processing signals and/or controlling the components associated with the BOP 24. The memory device 134 disclosed herein may include one or more memory devices (e.g., a volatile memory, such as random access memory [RAM], and/or a nonvolatile memory, such as read-only memory [ROM]) that may store a variety of information and may be used for various purposes. For example, the memory device 134 may store processor-executable instructions (e.g., firmware or software) for the processor 132 to execute, such as instructions for processing signals and/or controlling the components associated with the BOP 24. It should be appreciated that the controller 130 may include various other components, such as a communication device 136 that is capable of communicating data or other information (e.g., a current position or mode) to various other devices (e.g., a remote computing system).

Figure 7:
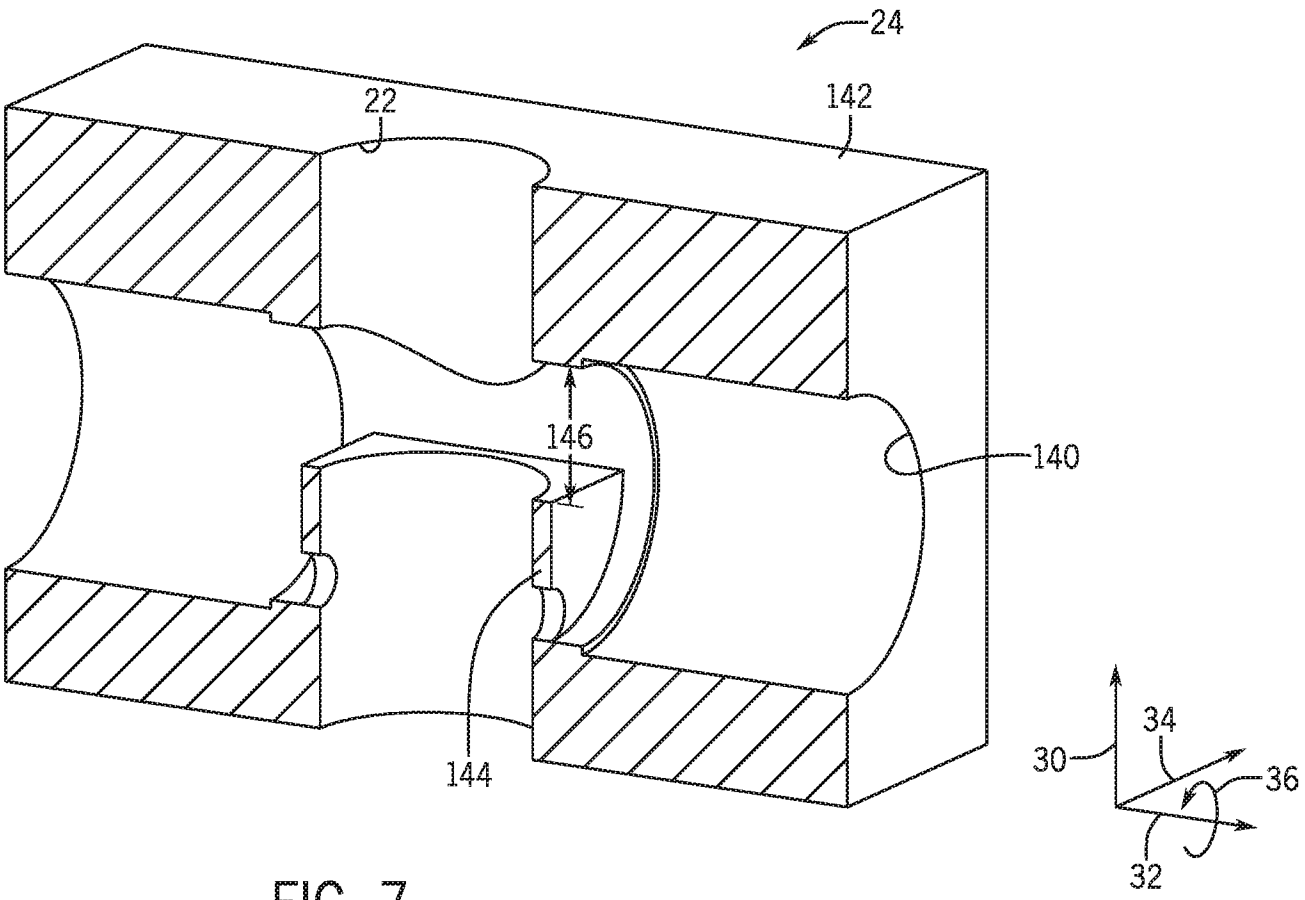
FIG. 7 is a cross-sectional perspective view of a dual function cavity that may be used in the BOP of FIG. 2, in accordance with an embodiment of the present disclosure.

FIG. 7 is a cross-sectional perspective view of a dual function cavity 140 that may be used in the BOP 24 of FIG. 2, in accordance with an embodiment of the present disclosure. As shown, the dual function cavity 140 (e.g., dual function ram cavity) extends through a body 142 (e.g., housing) of the BOP 24. The dual function cavity 140 is transverse to the central bore 22 of the BOP 24 (e.g., a respective central axis of the dual function cavity 140 is transverse, such as orthogonal, to a respective central axis of the central bore 22; a respective central axis of the dual function cavity 140 is aligned with the axial axis 32 and a respective central axis of the central bore 22 is aligned with the vertical axis 30). The dual function cavity 140 may include one or more stops 144 that are configured to block movement of a respective portion of a first dual function ram and a respective portion of a second dual function ram into the central bore 22. The one or more stops 144 may be configured to overlap with the respective portions of the first and second dual function rams along the vertical axis 30 to thereby block the movement of the respective portions of the first and second dual function rams into the central bore 22. As shown, a vertical gap 146 (e.g., having a semi-circular or D-shaped cross-sectional shape taken in a plane along the lateral axis 34) is provided between the one or more stops 144 and an upper portion of the dual function cavity 140 to enable other respective portions of the first and second dual function rams to move into the central bore 22. In the illustrated embodiment, the one or more stops 144 include an annular wall that is coaxial with the central bore 22; however, the one or more stops 144 may have any suitable structural configuration to facilitate the disclosed techniques. The dual function cavity 140 may be cylindrical (e.g., have a circular cross-sectional shape taken in a plane along the lateral axis 34) on opposite sides of the one or more stops 144 (e.g., outside of the central bore 22).

Figure 8:
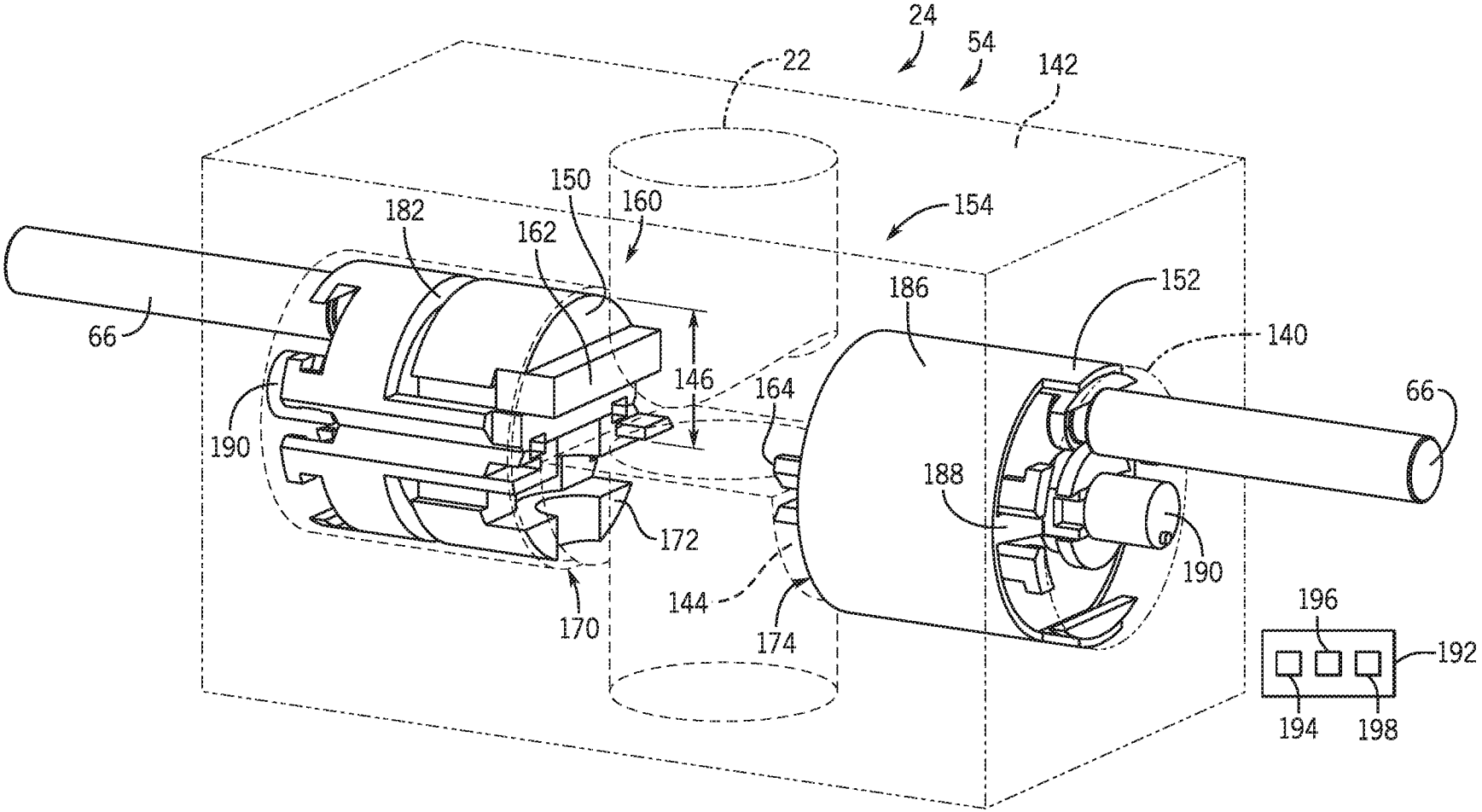
FIG. 8 is a perspective view of dual function rams that may be used in the dual function cavity of FIG. 7, wherein the dual function rams are in a first mode and are in a withdrawn position, in accordance with an embodiment of the present disclosure.
Figure 9:
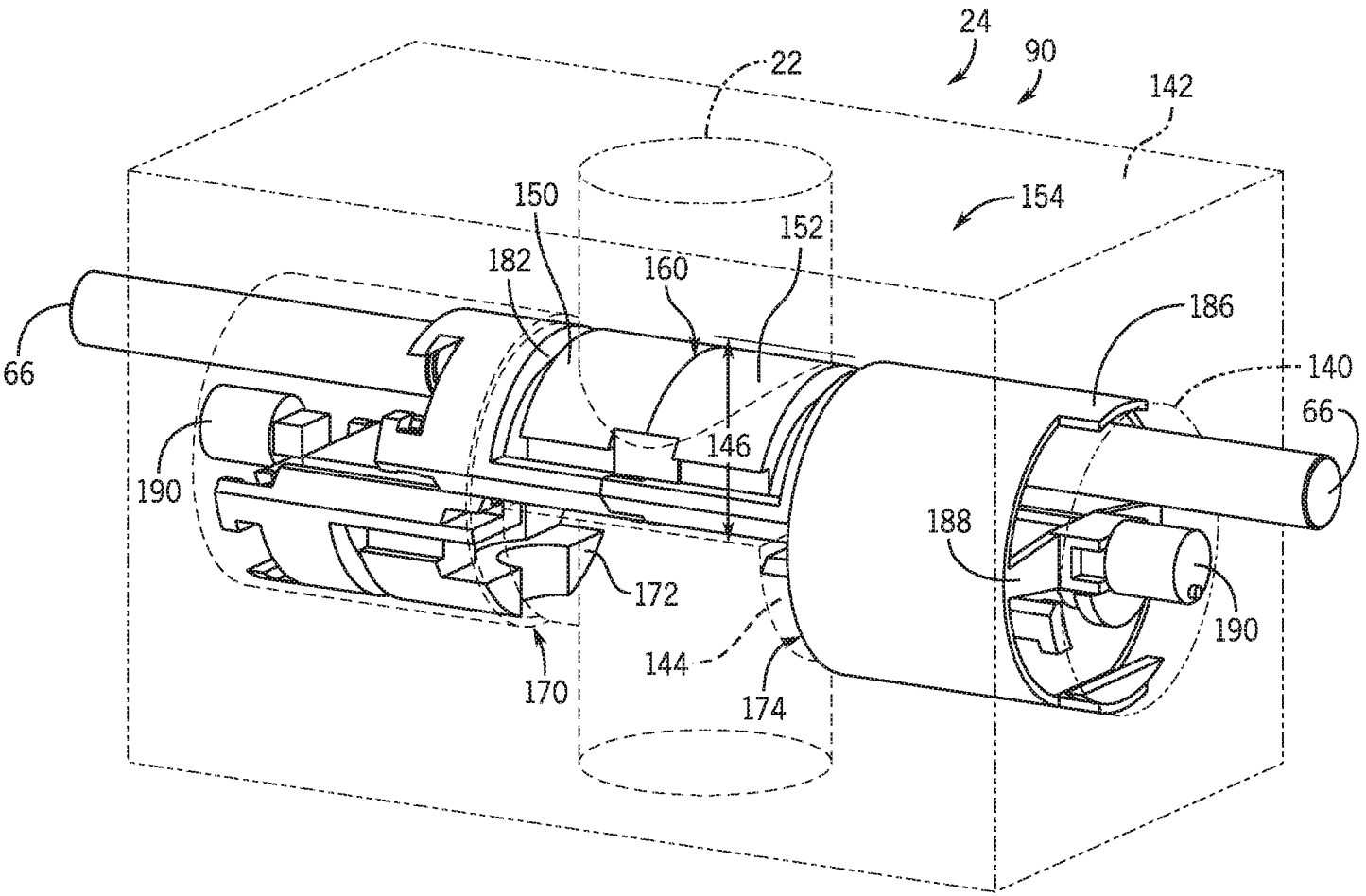
FIG. 9 is a perspective view of the dual function rams of FIG. 8, wherein the dual function rams are in the first mode and are in an extended position, in accordance with an embodiment of the present disclosure.

With the foregoing in mind, FIG. 8 is a perspective view of a first dual function ram 150 and a second dual function ram 152 that may be used in the dual function cavity 140 of FIG. 7, in accordance with an embodiment of the present disclosure. In FIG. 8, the first dual function ram 150 and the second dual function ram 152 are in a first mode 154 (e.g., shear mode) and withdrawn from the central bore 22 such that the BOP 24 is in the open configuration 54. In FIG. 9, the first dual function ram 150 and the second dual function ram 152 are in the first mode 154 and extend into the central bore 22 such that the BOP 24 is in the closed configuration 90.

As noted above, the first dual function ram 50 and the second dual function ram 52 may be configured to operate in two modes (e.g., different modes, which may correspond to different positions of the first and second dual function rams 150, 152 within the dual function cavity 140), such as the first mode 154 and a second mode. To enable the first and second dual function rams 150, 152 to operate in two modes, the first and second dual function rams 150, 152 may have two sets of opposing surfaces that are configured to engage one another. The two sets of opposing surfaces may be offset (e.g., about the circumferential axis 36) from one another such that only one of the two sets of opposing surfaces is positioned within the central bore 22 while the first and second dual function rams 150, 152 are extended with the BOP 24 in the closed configuration 90 of FIG. 9. The other set of the two sets of opposing surfaces is positioned outside of the central bore 22 while the first and second dual function rams 150, 152 are extended with the BOP 24 in the closed configuration 90 of FIG. 9 (e.g., due at least in part to the one or more stops 44 blocking movement of the other set of the two sets of opposing surfaces into the central bore 22).

In the illustrated embodiment, the first and second dual function rams 150, 152 each include two ram portions (e.g., a first portion having one surface of the first set of opposing surfaces and a second portion having one surface of the second set of opposing surfaces). Each of the ram portions has a semi-circular or D-shaped cross-sectional shape taken in a plane along the lateral axis 34, and the cross-sectional shape corresponds to or otherwise enables the first and second dual function rams 150, 152 to pass through the gap 146 (e.g., when aligned with the gap 146). Each of the ram portions is positioned adjacent to another one of the ram portions to form a generally cylindrical structure that fits within the portion of the dual function cavity 140. Each of the ram portions may move independently from the other ram portions (e.g., the ram portions of the first dual function ram 150 may move independently from one another; the ram portions of the second dual function ram 152 may move independently from one another).

With reference to FIGS. 8 and 9, the first and second dual function rams 150, 152 include a first set of opposing surfaces 160 that includes a first shear edge 162 (e.g., surface) on the first dual function ram 150 (e.g., on a body of the first dual function ram 150; on a portion of the body) and a second shear edge 164 (e.g., surface) on the second dual function ram 152 (e.g., on a body of the second dual function ram 152; on a portion of the body). In the first mode 154 (e.g., shear mode), the first shear edge 162 and the second shear edge 164 are positioned such that the first shear edge 162 and the second shear edge 164 enter the central bore 22 as the first and second dual function rams 150, 152 are driven to adjust the BOP 24 to the closed configuration 90 of FIG. 9. In particular, in the first mode 154, the first shear edge 162 and the second shear edge 164 may extend along the lateral axis 34, may be positioned at an upper portion of the dual function cavity 140 along the vertical axis 30, and/or may face toward one another so as to enable the first shear edge 162 and the second shear edge 164 to pass through the gap 146 into the central bore 22 to contact and to shear the conduit 20 (FIG. 2) in the central bore 22.

As shown in FIGS. 8 and 9, the first and second dual function rams 150, 152 also include a second set of opposing surfaces 170 that includes a first pipe edge 172 (e.g., surface) on the first dual function ram 150 (e.g., on a body of the first dual function ram 50; on a portion of the body) and a second pipe edge 172 (e.g., surface) on the second dual function ram 152 (e.g., on a body of the second dual function ram 152; on a portion of the body). In the first mode 154 (e.g., shear mode), the first pipe edge 172 and the second pipe edge 174 are positioned such that the first pipe edge 172 and the second pipe edge 174 do not enter the central bore 22 as the first and second dual function rams 150, 152 are driven to adjust the BOP 24 to the closed configuration 90 of FIG. 9. In particular, in the first mode 154, the first pipe edge 172 and the second pipe edge 174 may be positioned at a lower portion of the dual function cavity 140 along the vertical axis 30 so as to overlap with the one or more stops 144 along the vertical axis 30 and to thereby enable the one or more stops 144 to block the first pipe edge 172 and the second pipe edge 174 from contact with the conduit 20 (FIG. 2) in the central bore 22, to avoid placement within the central bore 22, and/or to avoid interference with the operation (e.g., shearing operation) of the first shear edge 162 and the second shear edge 164.

In operation, a portion of the first dual function ram 150 and a portion of the second dual function ram 152 (e.g., the portions aligned with the gap 146, such as the portions having the first shear edge 162 and the second shear edge 164) may move toward one another to transition the BOP 24 from the open configuration 54 of FIG. 8 to a closed configuration 90 of FIG. 9. Similarly, the portions of the first dual function ram 150 and the second dual function ram 152 may move away from one another to transition the BOP 24 from the closed configuration 90 of FIG. 9 to the open configuration 54 of FIG. 8. In the closed configuration 90, the portions of the first dual function ram 150 and the second dual function ram 152 extend into the central bore 22, seal the central bore 22, contact the conduit 20, and/or contact the corresponding opposing ram 50, 52.

The portions of first dual function ram 150 and the second dual function ram 152 may be driven to move toward and away from one another along the axial axis 32 via the actuator 62 of FIG. 2. For example, the connecting rod 66 of the actuator 62 may be aligned with the portions of the first dual function ram 150 and the second dual function ram 152 to enable the actuators 62 to drive the portions of the first dual function ram 50 and the second dual function ram 52 toward and away from one another along the axial axis 32.

Figure 10:
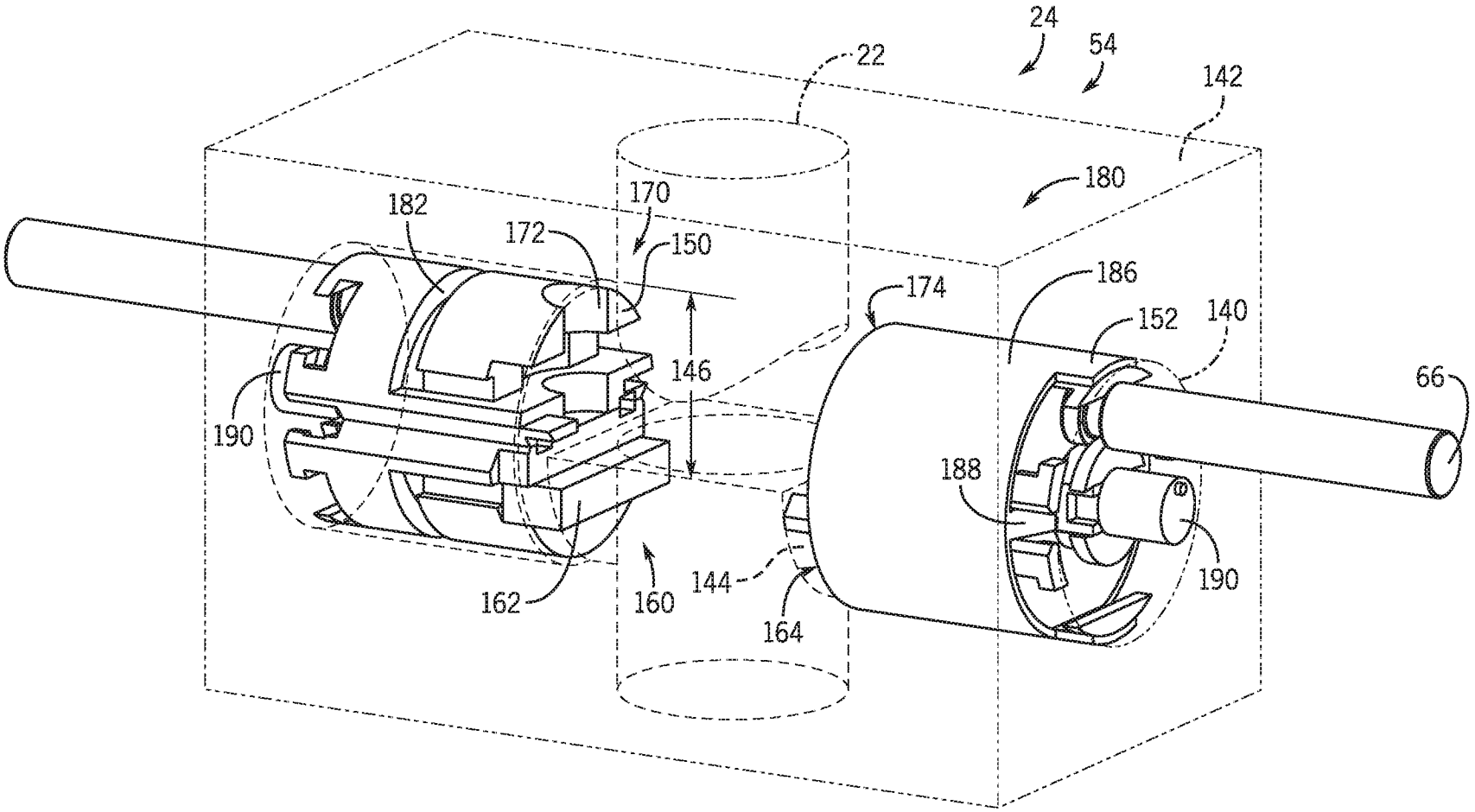
FIG. 10 is a perspective view of the dual function rams of FIG. 8, wherein the dual function rams are in a second mode and are in the withdrawn position, in accordance with an embodiment of the present disclosure.
Figure 11:
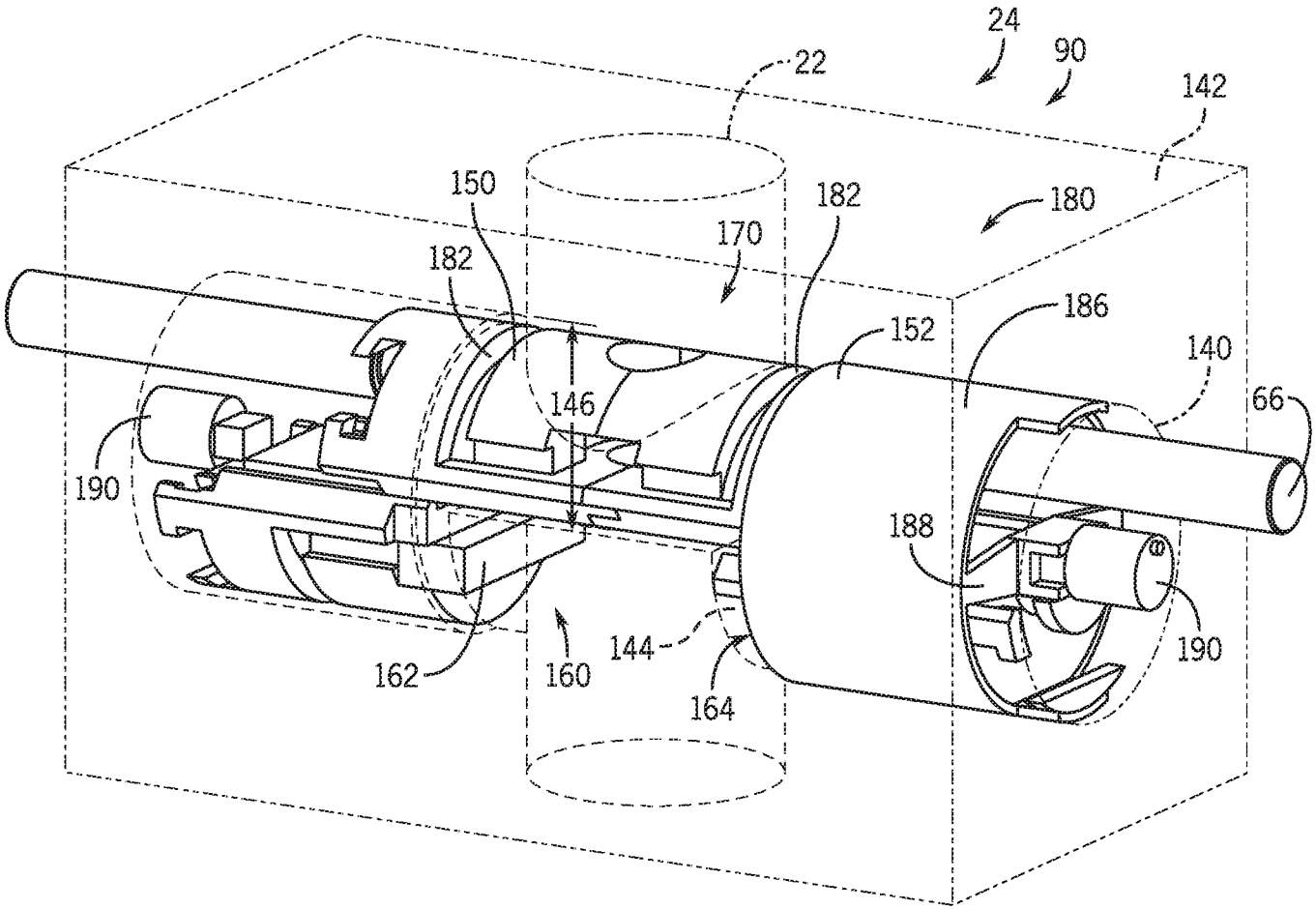
FIG. 11 is a perspective view of the dual function rams of FIG. 8, wherein the dual function rams are in the second mode and are in the extended position, in accordance with an embodiment of the present disclosure.

FIG. 10 is a perspective view of the first dual function ram 150 and the second dual function ram 152 in a second mode 180 (e.g., pipe mode) and withdrawn from the central bore 22 such that the BOP 24 is in the open configuration 54. FIG. 11 is a perspective view of the first dual function ram 150 and the second dual function ram 152 in the second mode 180 and extended into the central bore 22 such that the BOP 24 is in the closed configuration 90. The first dual function ram 150 and the second dual function ram 152 may move toward and away from one another to transition the BOP 24 between the open configuration 54 of FIG. 10 and the closed configuration 90 of FIG. 11.

In the second mode 180, the first pipe edge 172 and the second pipe edge 174 are positioned such that the first pipe edge 172 and the second pipe edge 174 enter the central bore 22 as the first and second dual function rams 150, 152 are driven to adjust the BOP 24 to the closed configuration 90 of FIG. 11. In particular, in the second mode 180, the first pipe edge 172 and the second pipe edge 174 may extend along the lateral axis 34, may be positioned at an upper portion of the dual function cavity 140 along the vertical axis 30, and/or may face toward one another so as to enable the first pipe edge 172 and the second pipe edge 172 to pass through the gap 146 into the central bore 22 so as to enable the first pipe edge 172 and the second pipe edge 174 to contact one another and to contact the conduit 20 (FIG. 2) to seal the annular space about the conduit 20 in the central bore 22.

In the second mode 180, the first shear edge 162 and the second shear edge 164 are positioned such that the first shear edge 162 and the second shear edge 164 do not enter the central bore 22 as the first and second dual function rams 150, 152 are driven to adjust the BOP 24 to the closed configuration 90 of FIG. 11. In particular, in the second mode 180, the first shear edge 162 and the second shear edge 164 may be positioned a lower portion of the dual function cavity 140 along the vertical axis 30 so as to overlap with the one or more stops 144 along the vertical axis 30 and to thereby enable the one or more stops 144 to block the first shear edge 162 and the second shear edge 164 from contact with the conduit 20 (FIG. 2) in the central bore 22, to avoid placement within the central bore 22, and/or to avoid interference with the operation (e.g., pipe-sealing operation) of the first pipe edge 172 and the second pipe edge 174.

As shown, the first dual function ram 150 and the second dual function ram 152 may be generally cylindrical structures and may include various sealing elements (e.g., packers) within grooves 182 to facilitate formation of a seal across the central bore 22 while the BOP 24 is in the closed configuration 90. The grooves 182 are shown without the sealing elements for image clarity. In some embodiments, each of the first and second dual function rams 150, 152 may be supported within a respective sleeve 186 (e.g., annular sleeve). In some embodiments, each of the first and second dual function rams 150, 152 may be coupled to the respective sleeve 186 (e.g., via an axially-extending key-slot interface; via a splined interface; via a bracket 188). As shown, each sleeve 186 may include the bracket 188 at one end (e.g., distal from the central bore 22). Each bracket 188 may be coupled (e.g., nonrotatably coupled) to a respective rotating shaft 190 that is configured to drive rotation of one of the sleeves 186, the first dual function ram 150, and the second dual function ram 152 within the dual function cavity 140 (e.g., relative to the body 142; in the circumferential direction 36) to thereby efficiently transition between the first mode 154 and the second mode 180.

The connecting rods 66 may be aligned with the portions of the first and second dual function rams 150, 152 that are at the upper portion of the dual function cavity 140. Thus, the connecting rods 66 may not rotate with the first and second dual function rams 150, 152. Instead, as may be understood with reference to FIG. 12, each connecting rod 66 may be temporarily (e.g., removably) coupled to the portion of its corresponding dual function ram (e.g., the second dual function ram 152, as shown in detail in FIG. 12) while the portion is at the upper portion of the dual function cavity 140 via an interface 191 (e.g., key-slot interface) to enable the connecting rod 66 to drive the portion of its corresponding dual function ram into and out of the central bore 22.

Figure 12:
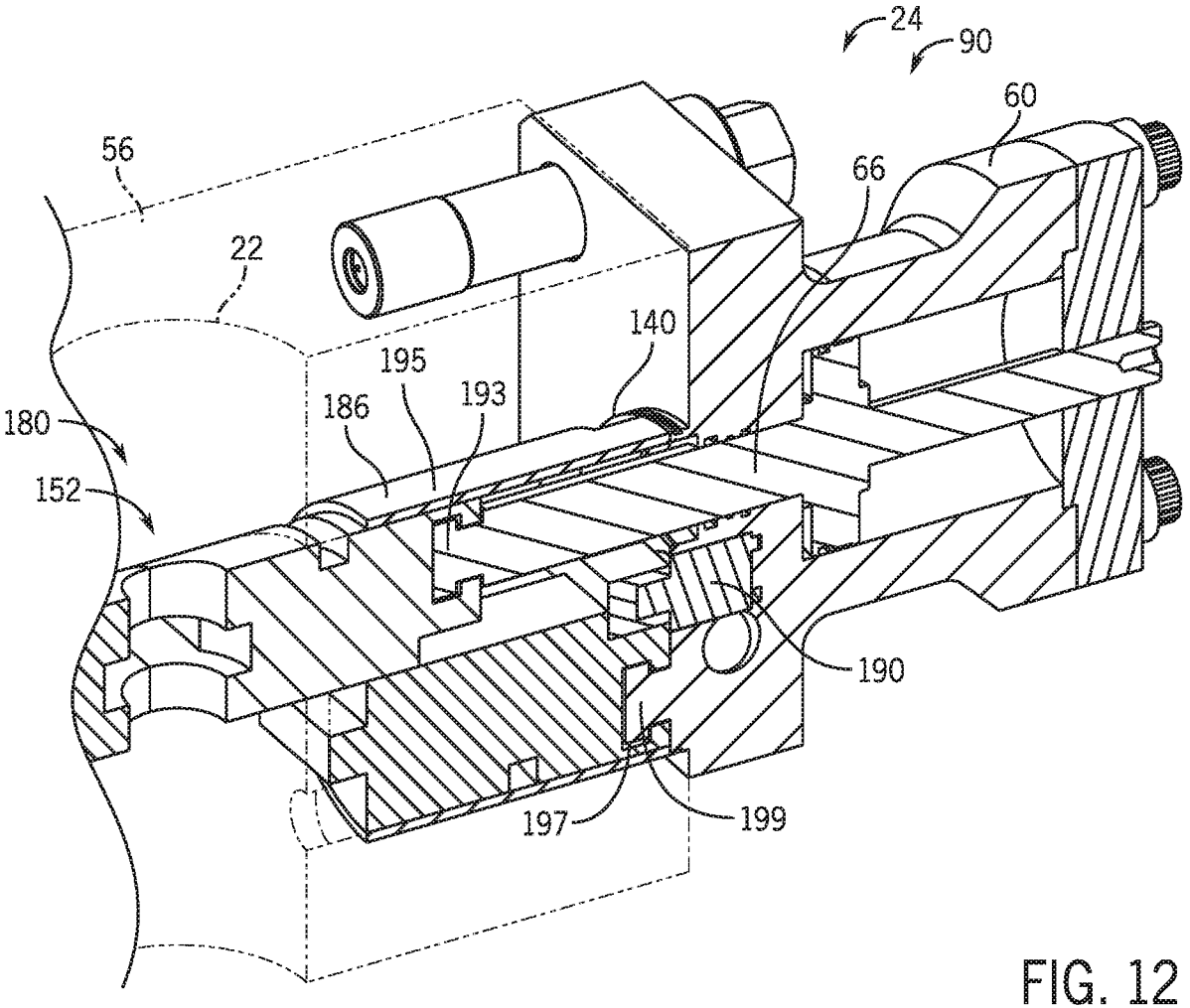
FIG. 12 is a cross-sectional perspective view of one of the dual function rams of FIG. 8, in accordance with an embodiment of the present disclosure.

For example, the interface 191 may include a key 193 (e.g., button) on the connecting rod 66 and a slot 195 (e.g., receptacle) on the portion of the dual function ram. When engaged in this manner, the connecting rod 66 may drive the portion of the dual function ram into and out of the central bore 22. To change to a different mode, the connecting rod 66 and the portion of the dual function ram may be withdrawn from the central bore 22. While in the withdrawn position, the sleeve 86 and the dual function ram may be driven to rotate relative to the connecting rod 66. During the rotation, the slot 195 on the portion of the dual function ram may separate from the key 193 on the connecting rod 66, and the slot 197 on the other portion of the dual function ram may then engage the key 193 on the connecting rod 66 once the other portion of the dual function ram reaches the upper portion of the dual function cavity 140. Once engaged in this manner, the connecting rod 66 may drive the other portion of the dual function into and out of the central bore 22. The bonnet 60 may include a support key 199 (e.g., button) that engages the slot 195, 197 of the respective portion of the dual function ram that is at the lower portion of the dual function cavity 140. It should be appreciated that the key portion of the interface may be on the portion of the dual function ram, and the slot portion of the interface may be on the connecting rod. Additionally, while FIG. 12 illustrates the second dual function ram 152, it should be appreciated that the first dual function ram 150 may include components that operate in the same way. Moreover, it should be appreciated that other techniques for coupling the first and second dual function rams 150, 152 and the connecting rods 66 may be employed.

In some embodiments, the sleeves 186 may have an inner diameter that is slightly greater than an outer diameter of the first and second dual function rams 150, 152 to reduce friction and wear on the sealing elements. One or more wear rings (e.g., annular rings) may be positioned about an outer surface (e.g., radially-outer surface) of the sleeves 186 to reduce friction and/or to block debris ingress (e.g., mud ingress) between the outer surface of the sleeve 186 and the body 142 that defines the dual function cavity 140. It should be appreciated that any of a variety of techniques may be utilized to rotate the first dual function ram 150 and the second dual function ram 152 in the manner disclosed herein. For example, the sleeve 186 may not be present and/or the rotating shafts 190 may directly interface with and engage one or both of the first and dual function rams 150, 152 to drive the first and second dual function rams 150, 152 to rotate within the dual function cavity 140.

Advantageously, the embodiment of the BOP 24 of FIGS. 7-12 may enable the BOP 24 to use the same rams (e.g., the first and second dual function rams 50, 52) to operate in two modes (e.g., the first mode 154 and the second mode 180) depending on which of the two modes is desired at the particular time. In this way, the embodiment of the BOP 24 of FIGS. 7-12 may enable the BOP 24 to use the same rams (e.g., the first and second dual function rams 150, 152) to carry out two operations (e.g., the shearing operation and the pipe-sealing operation) depending on which of the two operations is desired at the particular time. For example, the BOP 24 may operate in the second mode 180 to seal the annular space about the conduit 20 (FIG. 2) during planned maintenance operations, and the BOP 24 may be operate in the first mode 154 to shear the conduit 20 during an unexpected increase in pressure within the wellbore 18 (FIG. 1). The BOP 24 may efficiently switch between the first mode 154 and the second mode 180 via rotation of the first and second dual function rams 50, 52 within the dual function cavity 140 (e.g., via the rotating shafts 190).

It should be appreciated that manual and/or electronic control may be utilized to rotate the first and second dual function rams 150, 152. For example, an operator may manually drive rotation of the rotating shafts 190 to rotate the first and second dual function rams 150, 152. Additionally or alternatively, a control system (e.g., electronic control system) may electronically control the rotation of the rotating shafts 190 (e.g., via control of an actuator) to rotate the first and second dual function rams 150, 152. For example, the control system may receive an input (e.g., input by an operator via a user interface; from a sensor that monitors a pressure within the wellbore 18 [FIG. 1]). In response to the input, the control system may control the rotation of the rotating shafts 190 to rotate the first and second dual function rams 150, 152 to the desired position within the dual function cavity 140 to prepare for and to enable operation in the first mode 154 or the second mode 180. In some embodiments, the control system may also control the movement of the first and second dual function rams 150, 152 along the axial axis 32 to adjust the BOP 24 between the open configuration 54 and the closed configuration 90.

With reference to FIG. 8, the control system may include a controller 192 having a processor 194 and a memory device 196. The controller 192 may be part of or include a distributed controller or control system with one or more electronic controllers in communication with one another to carry out the various techniques disclosed herein. The processor 194 may also include one or more processors configured to execute software, such as software for processing signals and/or controlling the components associated with the BOP 24. The memory device 196 disclosed herein may include one or more memory devices (e.g., a volatile memory, such as random access memory [RAM], and/or a nonvolatile memory, such as read-only memory [ROM]) that may store a variety of information and may be used for various purposes. For example, the memory device 196 may store processor-executable instructions (e.g., firmware or software) for the processor 194 to execute, such as instructions for processing signals and/or controlling the components associated with the BOP 24. It should be appreciated that the controller 192 may include various other components, such as a communication device 198 that is capable of communicating data or other information to various other devices (e.g., a remote computing system).

Figure 13:
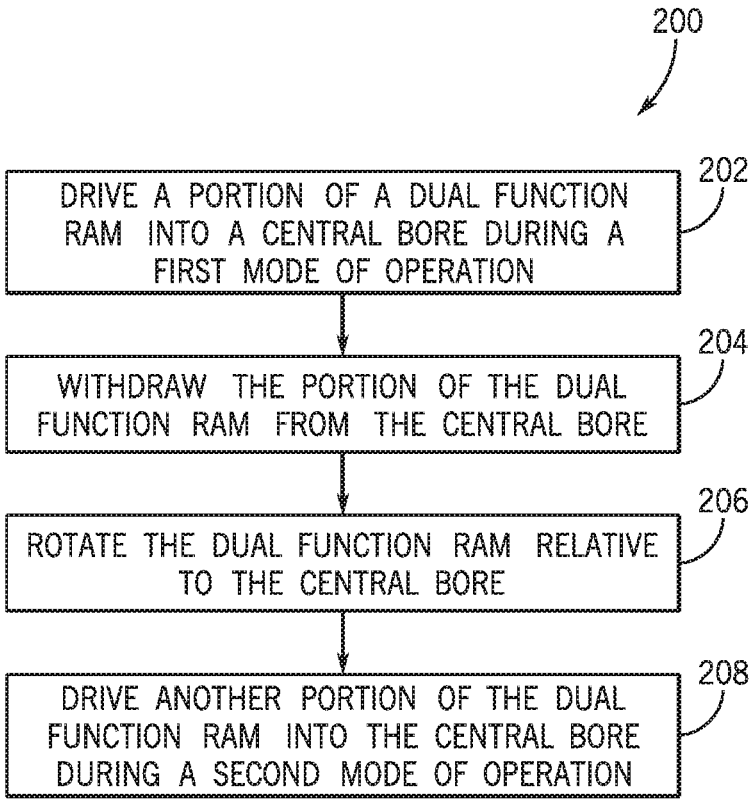
FIG. 13 is a flow diagram of a method of operating a BOP having dual function rams, in accordance with an embodiment of the present disclosure.

FIG. 13 is a flow diagram of a method 200 of operating a BOP (e.g., the BOP 24) having dual function rams (e.g., the dual function rams 50, 52 of FIGS. 3-6 or the dual function rams 150, 152 of FIGS. 7-12), in accordance with an embodiment of the present disclosure. The method 200 includes various steps represented by blocks. It should be noted that the method 200 may be performed as an automated procedure by a system, such as the controller 130, 192. Although the flow chart illustrates the steps in a certain sequence, it should be understood that the steps may be performed in any suitable order and certain steps may be carried out simultaneously, where appropriate. Further, certain steps or portions of the method 200 may be performed by separate devices. As noted above, the steps for using the dual function rams may be initiated automatically (e.g., following a signal that indicates that the BOP should be adjusted to the closed configuration and/or a signal that indicates that the BOP should be adjusted to a different mode).

In step 202, the dual function rams may be operated in a first mode by driving at least a portion of each dual function ram into a central bore. For example, a portion of a first dual function ram may be driven into the central bore via a respective actuator and a portion of a second dual function ram may be driven into the central bore via a respective actuator. The portions may include opposing edges (e.g., shear edges) that are configured to interact with (e.g., shear) a tubular within the central bore to carry out a first operation.

In step 204, the dual function rams may be withdrawn from the central bore. For example, the portion of the first dual function ram may be withdrawn from the central bore via the respective actuator and the portion of the second dual function ram may be withdrawn from the central bore via the respective actuator.

In step 206, the dual function rams may be adjusted to prepare for operation in a second mode. For example, the dual function rams may be rotated relative to the central bore. In step 208, the dual function rams may be operated in a second mode by driving at least another portion of each dual function ram into the central bore. For example, another portion of the first dual function ram may be driven into the central bore via the respective actuator and another portion of the second dual function ram may be driven into the central bore via the respective actuator. The portions may include opposing edges (e.g., pipe edges) that are configured to interact with (e.g., seal against) a tubular (e.g., the same tubular prior to the shearing step or another tubular) within the central bore to carry out a second operation (e.g., pipe-sealing operation).

While the embodiments are generally described with reference to a first mode being a shear mode that uses a first shearing edge and a second shearing edge and a second mode being a pipe-sealing mode that uses a first pipe edge and a second pipe edge to facilitate discussion, it should be appreciated that the dual function rams may have any of a variety of other configurations. For example, the first mode may be a pipe-sealing mode that uses a first pipe edge and a second pipe edge to seal about a tubular of a first diameter, and the second mode may be a pipe-sealing mode that uses another first pipe edge and another second pipe edge to seal about another tubular of a second diameter that is different from the first diameter. Similarly, the first mode may be a shearing mode that uses a first shear edge and a second shear edge to shear a tubular of a first diameter, and the second mode may be a shearing mode that uses another first shear edge and another second shear edge to shear another tubular of a second diameter that is different from the first diameter. Accordingly, the shear edges disclosed herein may be replaced with any type of edge (e.g., first edge, pipe edge) to carry out any type of operations and the pipe edges disclosed herein may be replaced with any type of edge (e.g., second edge, shear edge) to carry out any type of operation.

In some embodiments, the first mode and the second mode may be the same, the first edges may have the same configuration, and the second edges may have the same configuration to provide duplicate surfaces to improve wear and/or longevity (e.g., extend time between maintenance operations, such as repair or replacement). In some embodiments, additional modes (e.g., more than two) and/or additional sets of opposing surfaces (e.g., more than two) may be provided about each of the rams (e.g., triple-function rams, quadruple function rams). For example, the embodiments of FIGS. 3-6 may include additional sets of opposing surfaces about the circumference of the rams (e.g., three or four sets of opposing surfaces, such as two sets of shear edges and two sets of pipe edges).

While the disclosure may be susceptible to various modifications and alternative forms, specific embodiments have been shown by way of example in the drawings and have been described in detail herein. However, it should be understood that the disclosure is not intended to be limited to the particular forms disclosed. Rather, the disclosure is to cover all modifications, equivalents, and alternatives falling within the spirit and scope of the disclosure as defined by the following appended claims. Furthermore, any of the features described with respect to FIGS. 1-13 may be combined in any suitable manner.

The invention claimed is:

1. A dual function ram system for a blowout preventer (BOP), the dual function ram system comprising:

a first dual function ram configured to move within a cavity of the BOP between a withdrawn position to cause the BOP to be in an open configuration and an extended position to cause the BOP to be in a closed configuration, wherein the first dual function ram comprises a shearing surface that is configured to shear a tubular within a central bore during a shearing operation and a pipe-sealing surface that is configured to seal against the tubular within the central bore during a pipe-sealing operation.

2. The dual function ram system of claim 1, wherein the shearing surface and the pipe-sealing surface are offset from one another along a circumferential axis of the first dual function ram.

3. The dual function ram system of claim 1, wherein the first dual function ram comprises a cylindrical shape.

4. The dual function ram system of claim 1, wherein the first dual function ram comprises a curved groove, and the curved groove comprises a toothed surface that is configured to engage a corresponding toothed surface of a rotating shaft to enable rotation of the rotating shaft to drive rotation of the first dual function ram within the cavity of the BOP.

5. The dual function ram system of claim 1, comprising the cavity of the BOP, wherein the first dual function ram is configured to rotate within the cavity to a first position to enable the shearing surface to move into and out of the central bore along an axial axis.

6. The dual function ram system of claim 5, wherein the pipe-sealing surface is configured to be positioned outside of the central bore while the shearing surface is positioned within the central bore.

7. The dual function ram system of claim 6, wherein the pipe-sealing surface is configured to move with the shearing surface along the axial axis as the shearing surface moves into and out of the central bore along the axial axis.

8. The dual function ram system of claim 1, comprising a second dual function ram configured to move within the cavity of the BOP, wherein the second dual function ram comprises a respective shearing surface that is configured to shear the tubular within the central bore during the shearing operation and a respective pipe-sealing surface that is configured to seal against the tubular within the central bore during the pipe-sealing operation.

9. The dual function ram system of claim 1, comprising the cavity of the BOP, wherein the cavity comprises one or more stops configured to block entry of one of the shearing surface or the pipe-sealing surface into the central bore.

10. A blowout preventer (BOP), comprising:

a housing defining a central bore;

a cavity intersecting the central bore; and a first dual function ram supported within the cavity, wherein the first dual function ram is configured to move within the cavity along an axial axis between a withdrawn position to cause the BOP to be in an open configuration and an extended position to cause the BOP to be in a closed configuration, wherein the first dual function ram is configured to rotate within the cavity along a circumferential axis between a first position that enables a first surface of the first dual function ram to enter the central bore to carry out a first operation and a second position that enables a second surface of the first dual function ram to enter the central bore to carry out a second operation.

11. The BOP of claim 10, wherein the first surface comprises a shearing surface and the second surface comprises a pipe-sealing surface.

12. The BOP of claim 10, wherein the first surface and the second surface are offset from one another along the circumferential axis of the first dual function ram.

13. The BOP of claim 10, wherein the first dual function ram comprises a cylindrical shape.

14. The BOP of claim 10, wherein the first dual function ram comprises a curved groove, and the curved groove comprises a toothed surface that is configured to engage a corresponding toothed surface of a rotating shaft to enable rotation of the rotating shaft to drive rotation of the first dual function ram within the cavity of the BOP.

15. The BOP of claim 10, wherein the first surface is configured to be positioned outside of the central bore while the second surface is positioned within the central bore, and wherein the second surface is configured to be positioned outside of the central bore while the first surface is positioned within the central bore.

16. The BOP of claim 10, wherein the first surface and the second surface are configured to move together along the axial axis.

17. The BOP of claim 10, comprising a second dual function ram configured to move within the cavity of the BOP, wherein the second dual function ram is configured to move within the cavity, wherein the second dual function ram is configured to rotate within the cavity along the circumferential axis between a respective first position that enables a respective first surface of the second dual function ram to enter the central bore to carry out the first operation and a respective second position that enables a respective second surface of the second dual function ram to enter the central bore to carry out the second operation.

18. The BOP of claim 10, wherein the cavity comprises one or more stops configured to block entry of one of the first surface or the second surface into the central bore.

* * * * *